US007058994B2

(12) United States Patent
Weimer et al.

(10) Patent No.: US 7,058,994 B2
(45) Date of Patent: Jun. 13, 2006

(54) STARTING PLATFORM AND ANCHOR SYSTEM

(75) Inventors: Joey Bill Gene Weimer, Milltown, MT (US); John Maguire, Missoula, MT (US)

(73) Assignee: Spectrum Products, LLC, Missoula, MT (US)

( * ) Notice: Subject to any disclaimer, the term of this patent is extended or adjusted under 35 U.S.C. 154(b) by 71 days.

(21) Appl. No.: 10/685,888

(22) Filed: Oct. 15, 2003

(65) Prior Publication Data

US 2004/0199990 A1 Oct. 14, 2004

Related U.S. Application Data

(60) Provisional application No. 60/461,443, filed on Apr. 9, 2003.

(51) Int. Cl.
*E04H 4/00* (2006.01)

(52) U.S. Cl. ..... 4/496

(58) Field of Classification Search ..... 4/496; 482/30–32, 55, 56; 472/128; 434/254; D21/802; D25/2; 343/254
See application file for complete search history.

(56) References Cited

U.S. PATENT DOCUMENTS

| | | | | |
|---|---|---|---|---|
| D202,546 | S | 10/1965 | French | |
| 3,390,740 | A * | 7/1968 | Brandel et al. | 182/113 |
| D216,502 | S * | 1/1970 | Meyer | D21/802 |
| 3,809,392 | A | 5/1974 | Kral, Jr. | |
| 3,813,703 | A * | 6/1974 | Beaudin, Jr. | 4/487 |
| 3,916,214 | A | 10/1975 | Coble, Jr. et al. | |
| D240,811 | S | 8/1976 | Beall, Jr. | |
| 4,495,883 | A * | 1/1985 | Hoy | 114/343 |
| 4,780,085 | A | 10/1988 | Malone | |
| 4,907,674 | A * | 3/1990 | Miller | 182/150 |
| 5,014,370 | A * | 5/1991 | Stark, Sr. | 4/505 |
| 5,040,251 | A * | 8/1991 | Hanford | 4/496 |
| 5,660,013 | A | 8/1997 | Saldarelli et al. | |
| 5,916,031 | A | 6/1999 | Casillan | |
| 6,209,147 | B1 * | 4/2001 | Wheaton | 4/496 |
| 6,247,935 | B1 * | 6/2001 | Martin et al. | 434/254 |
| D464,699 | S | 10/2002 | Brice | |
| D464,700 | S | 10/2002 | Kiefer et al. | |
| D464,701 | S | 10/2002 | Kiefer et al. | |
| 6,461,018 | B1 | 10/2002 | Chanslor | |
| 6,523,188 | B1 * | 2/2003 | Kiefer et al. | 4/496 |
| 6,532,606 | B1 * | 3/2003 | Skovronski | 4/496 |

OTHER PUBLICATIONS

Paragon Aquatics, Competitive Starting Platforms, p. 2).*

* cited by examiner

*Primary Examiner*—Justine R. Yu
*Assistant Examiner*—Huyen Le
(74) *Attorney, Agent, or Firm*—Volpe and Koenig, P.C.

(57) ABSTRACT

A swimmer's starting platform assembly and method includes a cylindrical anchor/post mating system having a keyed angular positioning device. Preferably, a starting platform has a cylindrical support post sized for mating engagement within a cylindrical bore of an anchor. The cylindrical support post has a mating key element configured to mate with an anchor key element when the cylindrical support post is inserted into the cylindrical bore to maintain a fixed angular orientation between the cylindrical support post and the cylindrical bore so that the starting platform is fixed with a desired orientation relative to the anchor.

14 Claims, 3 Drawing Sheets

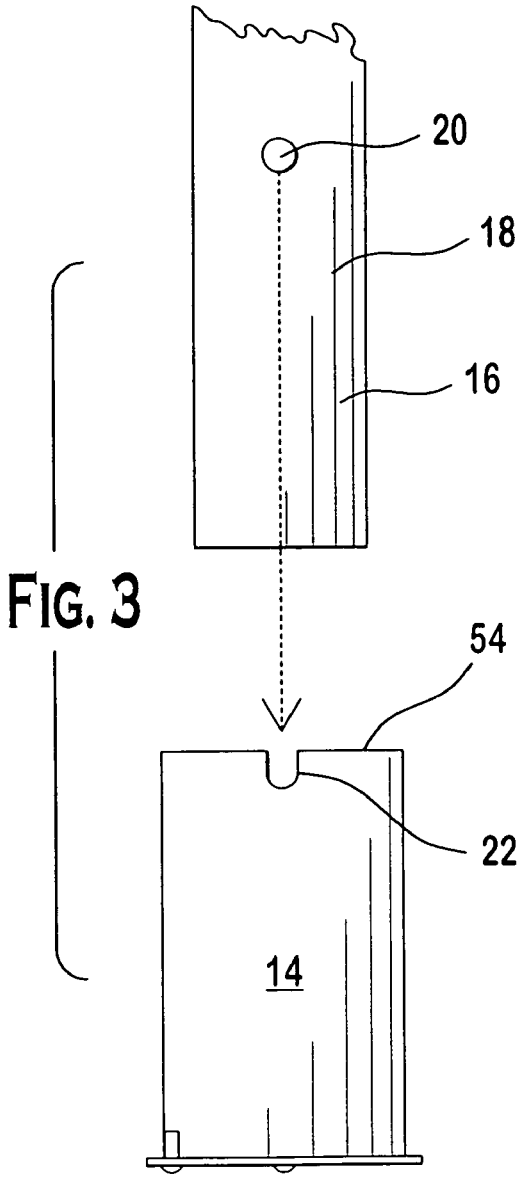
FIG. 3
FIG. 5
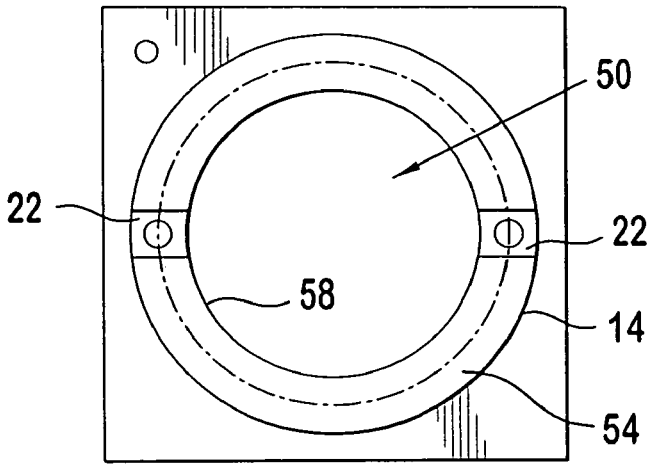
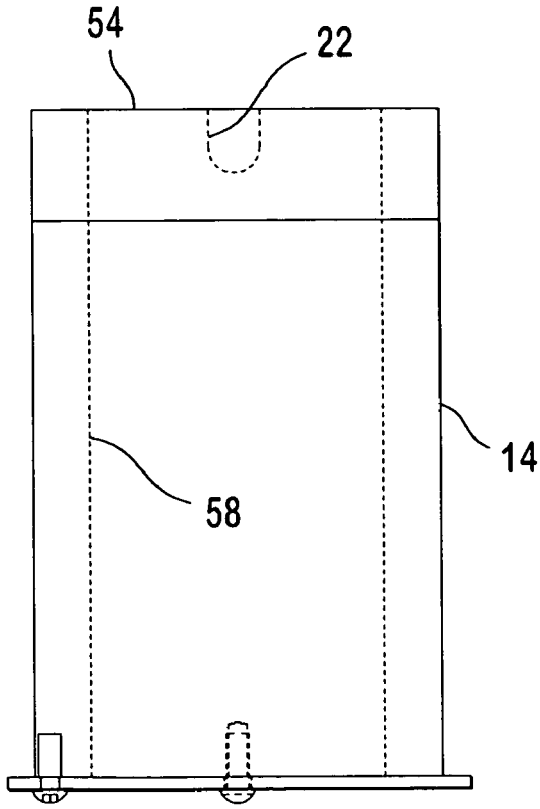
FIG. 4

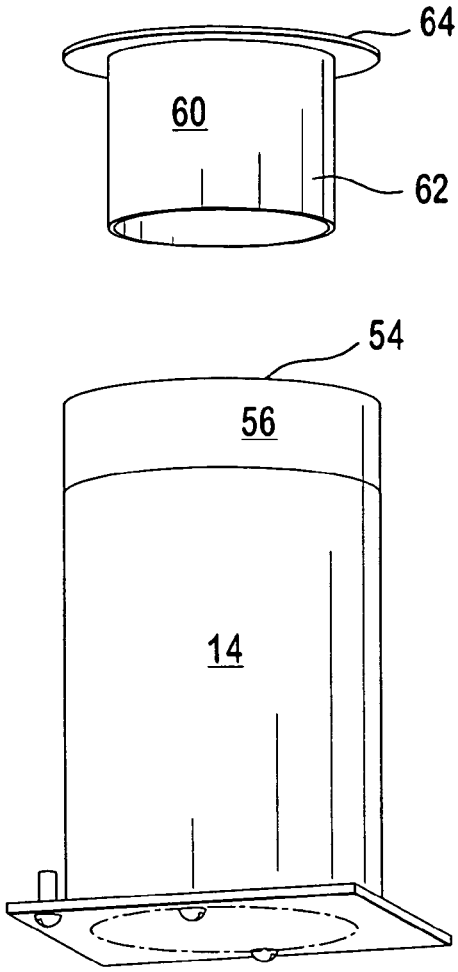
FIG. 6
FIG. 8
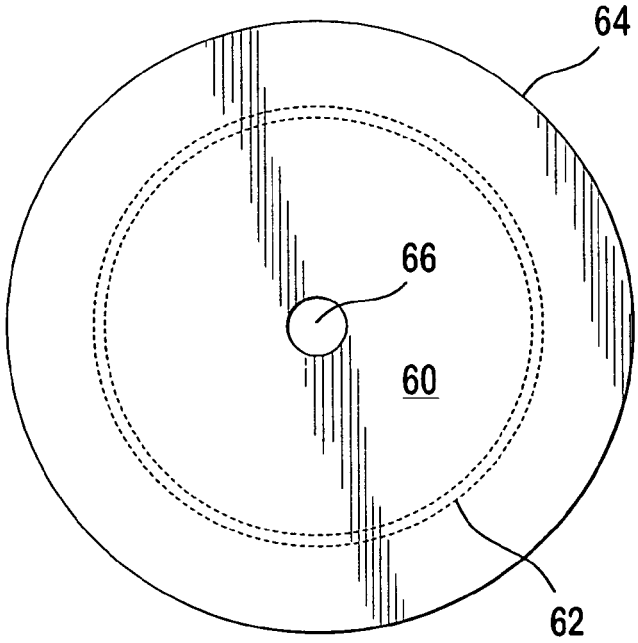
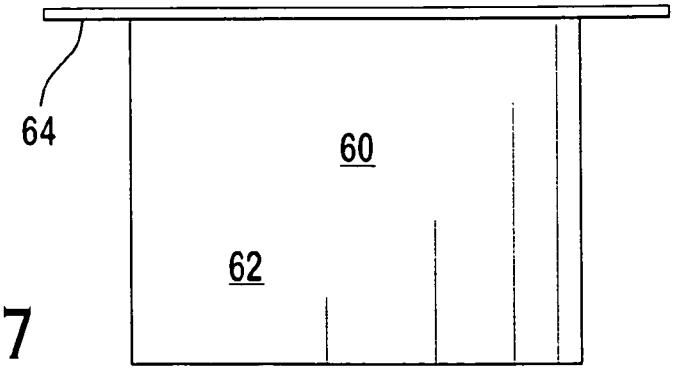
FIG. 7

STARTING PLATFORM AND ANCHOR SYSTEM

CROSS-REFERENCE TO RELATED APPLICATION

This application claims benefit of and priority to U.S. Provisional Patent 60/461,443, filed Apr. 9, 2003, and entitled "Starting Platform and Anchor System," which is hereby incorporated by reference herein in its entirety as if fully set forth.

FIELD OF THE INVENTION

The present invention is directed generally to starting platforms and, more specifically, to a starting platform incorporating an improved anchor system which is easy to install and virtually eliminates the need for shims to stabilize the platform within the anchor.

BACKGROUND

Starting platforms for swimming races are well known in the art. Various systems have been employed for anchoring starting platforms to a pool deck. Since very few swimming pools are dedicated exclusively to racing, it is desirable for the starting platforms to be mounted on the deck in a manner which makes them easily removable, but ensures the stability of the starting platform. Conventionally, support posts for a starting platform are provided with an anchor plate which is bolted to a corresponding fitting that is set in concrete material of a pool deck. However, bolting and unbolting of such platforms is a cumbersome operation. Also, when such platforms are removed, an ancillary cover is required for the complementary deck member.

In order to facilitate the quick installation and removal of starting platforms, socket members formed by hollow rectangular tubing are known which are set in the concrete deck of a pool. Such rectangular socket members have a complementary cross-sectional configuration relative to the cross-sectional configuration of supporting posts for associated starting platforms. While this type of system provides much faster installation and removal operations, in practice it has proved to be extremely difficult to provide the close tolerances necessary to prevent wobbling of the starting platforms. This wobbling is largely due to the need to separately mill each of the four sides of the rectangular tubing to within a very small tolerance.

Various attempts have been made to address this problem by providing wedges which can be driven between the socket and the support post. However, but these procedures met with mixed results. If the wedges are driven tight enough to eliminate all wobble, it becomes extremely difficult to remove the platform post from the anchor socket when removal of the starting platform is desired.

It would be advantageous to provide a starting platform anchor system that allows the starting platform to be easily installed and removed when not in use and that is less prone to wobbling during use without employing shims or wedges.

SUMMARY

The present invention is directed to a swimmer's starting platform assembly including a cylindrical anchor/post mating system having a keyed angular positioning device. Preferably, a starting platform has a cylindrical support post sized for mating engagement within a cylindrical bore of an anchor. The cylindrical support post has a mating key element configured to mate with an anchor key element when the cylindrical support post is inserted into the cylindrical bore to maintain a fixed angular orientation between the cylindrical support post and the cylindrical bore so that the starting platform is fixed with a desired orientation relative to the anchor.

The present invention is also directed to a method for deploying a swimmer's starting platform assembly having an anchor portion and a removable starting platform portion for use during swimming events. The anchor portion and the starting platform portion are provided with respective cylindrical mating elements for initial engagement at any arbitrary angular orientation. The anchor portion and the starting platform portion are also provided with respective mating key elements for fixing their mating engagement at a desired angular orientation when fully engaged. The anchor portion is secured at a selected location proximate a swimming area such that the anchor has a selected orientation relative to the swimming area. The cylindrical mating elements of the anchor portion and starting platform portion are initially engage. Thereafter, the mating key elements of the anchor portion and starting platform portion are engaged to provide a fully engaged position whereby the starting platform portion is securely positioned for use with a desired orientation relative to the swimming area based on the selected orientation of the anchor.

The foregoing summary, as well as the following detailed description of the preferred embodiment of the present invention, will be better understood when read in conjunction with the appended drawings. For purposes of illustrating the invention, there are shown in the drawings an embodiment which is presently preferred. It is understood, however, that the present invention is not limited to the precise arrangement and instrumentality shown.

BRIEF DESCRIPTION OF THE DRAWINGS

FIG. 3 is an enlarged view of a post and anchor identified in FIG. 2.

FIG. 4 is an enlarged elevational view of the anchor of FIG. 1 with tape around an upper portion thereof.

FIG. 5 is a top plan view of the anchor of FIG. 4.

FIG. 6 a perspective view of the anchor of FIG. 4 and an anchor cap.

FIG. 7 is an enlarged elevational view of the anchor cap of FIG. 6.

FIG. 8 is top plan view of the anchor cap of FIG. 7.

DETAILED DESCRIPTION OF THE PREFERRED EMBODIMENT(S)

Figure 1:
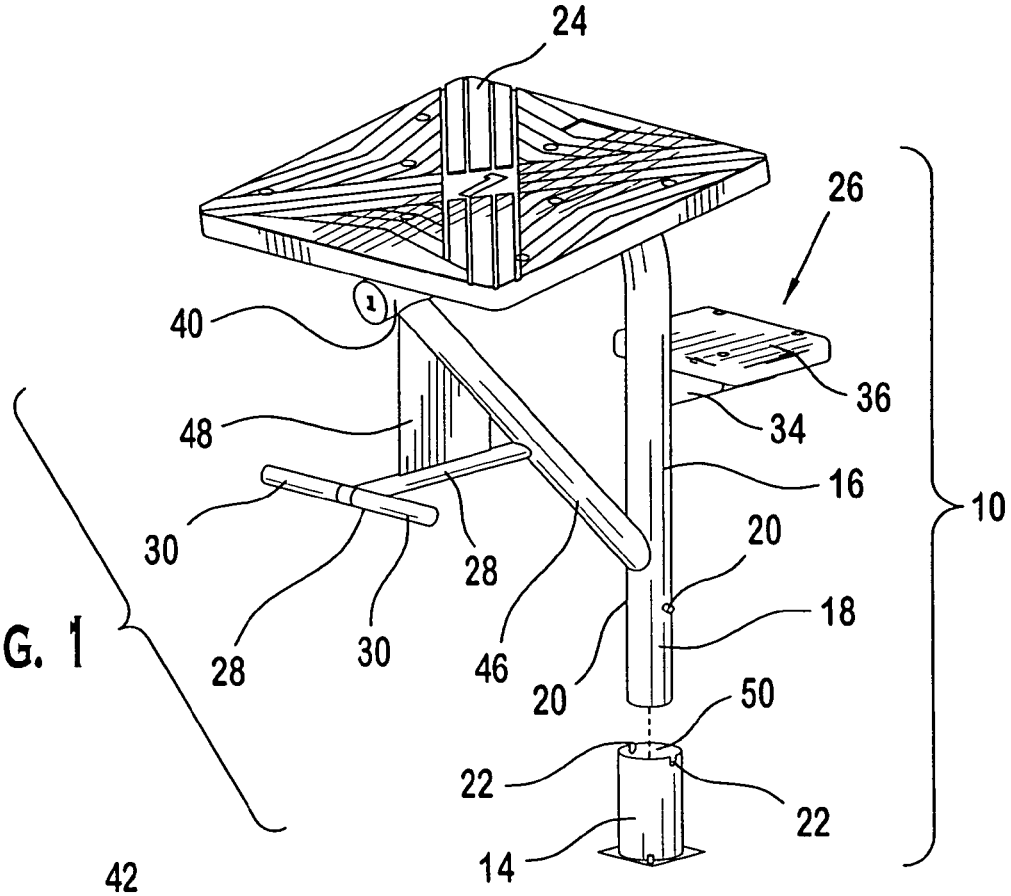
FIG. 1 is a perspective view of a combination starting platform and anchor made in accordance with the teaching of the present invention prior to insertion of the starting platform into the anchor.

Certain terminology is used in the following description for convenience only and is not limiting. The words "right," "left," "upper," and "lower" designate directions in the drawings to which reference is made. The words "inwardly" and "outwardly" refer to directions toward and away from, respectively, the geometric center of the starting platform and designated parts thereof. Additionally, the words "a" and "one" are defined as including one or more of the referenced item unless specifically stated otherwise. The terminology includes the words above specifically mentioned, derivatives thereof, and words of similar import.

Referring to FIGS. 1–8, wherein like numerals indicate like elements throughout, a preferred embodiment of a combination starting platform and anchor is shown and generally designated as 10. The combination starting platform and anchor 10 uses a keyed cylindrical support system. Preferably, the support system includes a cylindrical platform post 18 that can be mateably inserted into a cylindrical bore 50 of an anchor 14. When engaged, the cylindrical elements are angularly secured via the engagement of a mating key system. Preferably, the key system includes a platform post pin 20 with an anchor key slot 22 in the anchor 14.

Figure 2:
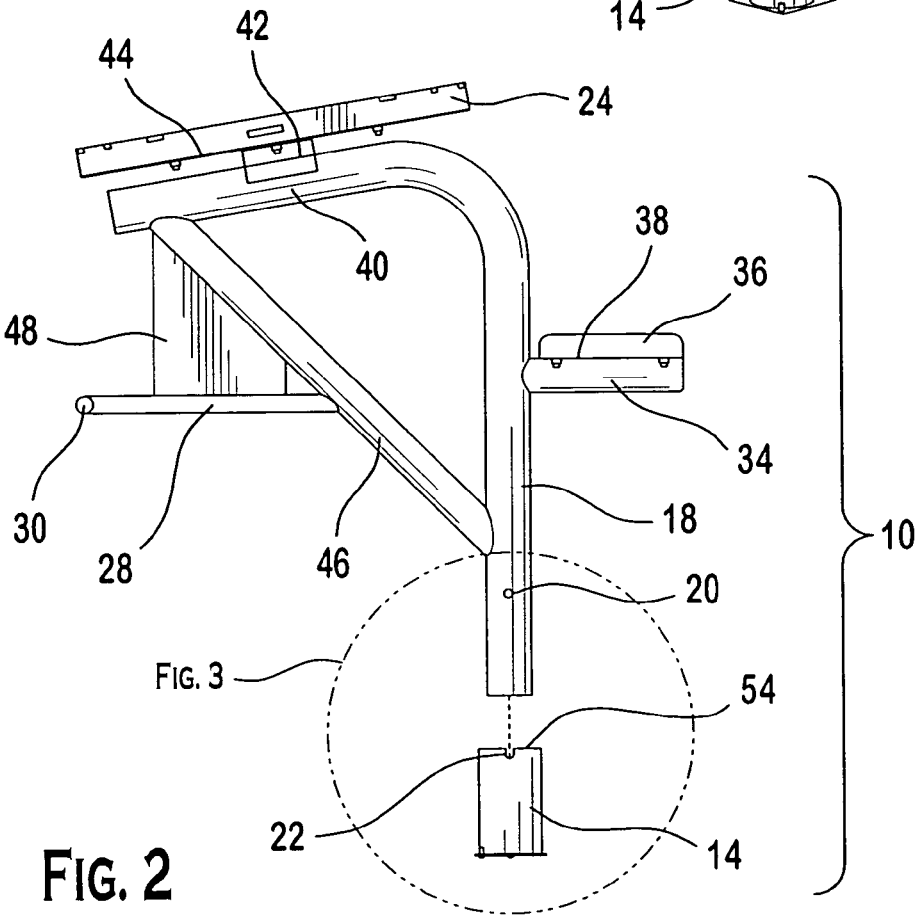
FIG. 2 is a right side elevational view of the combination starting platform and anchor of FIG. 1.

Referring to FIGS. 1 and 2, a preferred embodiment of the starting platform assembly 10 is shown. The starting platform assembly 10 includes a starting platform portion 26 that is supported the cylindrical support element 18. The cylindrical support element 18 is preferably bent such that an upper post portion 40 provides support for a diving platform 24. It is preferred that a cross support member 42 be welded on the top of a portion of the upper post member 40 and oriented generally perpendicularly thereto. It is also preferred that a plate 44 is welded to the top of the cross support member 42 to allow the diving platform 24 to be fastened thereto. A diagonal support member 46 is preferably welded to the support post 18 to strengthen and maintain the shape of the support post 18 and, accordingly, the relative orientation of the diving platform 24.

The diving platform 12 optionally includes a backstroke bar 28. The backstroke bar 28 preferably has a generally T-shape that results in two handles 30 that can be grasped by the swimmer. The backstroke bar 28 is preferably welded to the support member 46 and further supported by a flange 48 that extends between the backstroke bar 28 and a portion of the support member 46 located above the backstroke bar 28.

The starting platform 26 preferably includes a step 36 to facilitate the climbing onto the diving platform 24 by swimmers. A step support post 34 is preferably welded to the platform post 18 such that it extends generally away from the backstroke bar 28 to support the step 36. A step mounting plate 38 is preferably welded on an upper surface the post 34. The step 36 is preferably fastened on the top of the plate 38 by use of conventional fasteners to secure the step 36 in position.

It is preferred that the starting platform 26 and its component parts are generally formed of durable, strong, corrosion resistant material, such as aluminum or the like. Those of ordinary skill in the art will appreciate that the starting platform and anchor may be formed by any suitable material, such as, stainless steel, alloy, or the like, without departing from the scope of the present invention.

While a preferred starting platform 26 has been described above, those of ordinary skill in the art will appreciate from this disclosure that various types of starting platforms, platform features, and aspects of construction (such as molding the entire starting platform support as a single piece) can be varied without departing from the scope of the present invention.

The starting platform 26 is removably engageable with the anchor 14. The anchor 14 is preferably embeddedly mounted in a selected fixed position within a pool deck so that it does not protrude above the deck surface. The positioned is selected such that when the starting platform 26 is properly mated with the anchor in a keyed orientation, the dive platform 24 and the backstroke bar 28 are positioned so that a swimmer preparing to begin a race can take an appropriate pre-race position.

The starting platform post 18 is preferably secured within the cylindrical bore 50 of the anchor 14 within an acceptably small tolerance such that wobbling of the starting platform 26 does not occur during use. The preferred circular cross-section of the platform post 18 reduces the tolerance errors that occur during manufacturing and, thus reduces the manufacturing cost of the starting platform significantly.

The outer circumference of the platform post 18 can be selectively sized by a single milling operation or like procedure. This simplifies the forming of the cylindrical support member 18 with a uniform radius along the entire perimeter of the portion of the platform post 18 which mates with the anchor 14. Thus, the use of a cylindrical support post 18 eliminates many of the tolerance errors resulting from using tubular members having a generally rectangular, or polygonal, cross-section. Manufacturing tubing having a polygonal shape requires multiple milling operations to be performed during the manufacturing process which increases the likelihood of manufacturing errors occurring.

Similarly the bore 50 of the anchor 14 can be formed using a single milling operation or the like. Accordingly, the relative the sizing of the cylindrical components can be precisely controlled such that the platform post 18 fits precisely within a bore 50 in the anchor 14. The ability to precisely fit the platform post 18 within the anchor 14 eliminates the need for wedges or shims to be used to prevent the starting platform 12 from wobbling within the anchor 14 during use.

Preferably the outer diameter of the support post 18 is within approximately ±0.003 inches (+0.0762 mm) of the inner diameter of the anchor bore 50. Due to the close fit, the lower edge of the post 18 may be slightly beveled and/or the upper edge of the anchor bore 50 may be slightly flared to make insertion of the post into the bore easier.

The keying assembly to fix the starting platform 26 in a selected angular position relative to the anchor 14 preferably includes at least one pin 20 that functions as a key element and an associated mating slot 22. As best seen in to FIG. 3, the pin 20 preferably extends generally radially outwardly from the platform post 18 and is sized to slidingly engage a groove 22 formed in an upper lip 54 of the anchor 14.

Referring to FIGS. 1 and 3, it is preferred that two key pins 20 are formed by a single rod that extends through the center of the cylindrical support post 18 to define opposed pins 20 extending radially outwardly from opposite surfaces of the post 18. The anchor, accordingly, has two opposing slots 22 to receive the opposing post pins 20. This provides two engagement points between the platform post and the anchor 14 to prevent the starting platform 12 from rotating within the anchor 14. If desired, one or more pairs of additional slots can be provided to enable the platform 26 to be secured in one or more additional orientations relative to the anchor. However, ordinarily only a single keyed orientation is desired.

Preferably, the depth of the bore 50, length of the slots 22 and the location of the pins 20 up the mating end 16 of the support post 18 are selected such that the end of the post 18 engages the bottom of the anchor bore 50 only when the pins 20 are disposed within the slots 22. In such position, the starting platform is in its selected keyed mating position with the anchor 14. Preferably, the pins 20 do not rest on the bottom of the slots 22 without the bottom of the post 18 resting on the bottom of the anchor 14 to avoid the pins from bearing the entire weight of the platform 26 and, when used, its occupant.

Those of ordinary skill the art will appreciate that the pins 20 may be welded or otherwise attached to the outside of the platform post 18 without departing from the scope of the present invention. While the pins 20 are shown as being generally cylindrical, the pins 20 may have any cross-sectional shape without departing from the scope of the present invention.

For concrete deck installations, a desired number of anchors 14 are selectively positioned in the wet concrete used to form the pool deck, either before during or after the concrete is poured. As shown in FIGS. 4 and 6, aluminum tape 56 or the like can be wrapped around an upper portion of the anchor 14 to cover the exterior of the slots 22 to facilitate the setting of the anchor 14 within concrete of a concrete pool deck. While it is preferred that an inner anchor wall 58 define a bore 50 having generally circular cross-section, those of ordinary skill in the art will appreciate that the shape of the outer surface of the anchor 14 can be any of various shapes as proves advantageous for embedding the anchor 14 without departing from the scope of the present invention.

Referring to FIGS. 6–8, an anchor cap 60 is preferably provided to cover the anchor bore 50 when the starting platform 12 is removed from the anchor 14. The anchor cap 60 includes a plug portion 62 that is sized complementarily to the bore 50 such that the outer surface of the plug portion 62 can be positioned generally against or very close to the inner anchor wall 58 when the anchor cap 60 is positioned within the anchor 14. The anchor cap 60 also includes a circumferential lip 64 that is adapted to rest on the upper lip 54 of the anchor to prevent the plug portion 62 from being fully inserted into the bore 50.

As best shown in FIG. 8, it is preferred that a generally central portion of the top of the anchor cap 60 includes a hole 66 to facilitate the removal of the anchor cap 60 from the anchor 14. The anchor cap 60 is removed from the anchor 14 by inserting an appropriate pry device or tool within the hole 66 and then the pulling the anchor cap 60 out of the anchor 14.

One embodiment of the present invention operates as follows, an anchor 14 is embedded within a pool deck. The anchor 14 preferably has a bore 50 defined by an inner anchor wall 58 having a generally circular cross-section. The anchor 14 preferably has at least one groove 22 in an upper lip 54 thereof. The starting platform 12 has a cylindrical support member 18 having a preferably generally circular cross-section that is complementarily sized to precisely fit within the bore 50 of the anchor 14. At least one pin 20 preferably extends generally outwardly from the cylindrical support member 18 and is adapted to engage the groove 22 in the anchor 14. Thus, the mating key element 20 is configured to be engageable with the anchor key element 22 when the cylindrical support member 18 is inserted into a preferably cylindrical bore 50 to maintain a fixed angular relation between the cylindrical support member and the cylindrical bore so that the starting platform 12 is fixed with a desired orientation relative to the anchor 14. The precise fit that can be achieved between the cylindrical support member 18 and the anchor 14 without resort to expensive and inefficient manufacturing methods results in a thoroughly satisfactory starting platform 12 that is relatively efficient to assemble and disassemble and does not wobble or move during use.

It is recognized by those skilled in the art, that changes may be made to the above described embodiment of the invention without departing from the broad invention concept thereof. For example, while the pin 20 and groove 22 are used to key the position of the starting platform 12 within the anchor 14, any suitable keying mechanism (such as having a shaped member that extends downwardly from the cylindrical support member 18 which mates with a recess inside the anchor 14) can be employed to prevent the starting platform 12 from rotating within the anchor 14. It is understood, therefore, that this invention is not limited to the particular embodiment disclosed, but is intended to cover all modifications which are within the spirit and scope of the invention as defined by the appended claims and shown in the attached drawings.

What is claimed is:

1. A swimmer's starting platform assembly comprising:

an anchor portion for fixed mounting relative to a swimming area and a removable starting platform portion for use during swimming events;

said portions having respective cylindrical mating elements for initial engagement at any arbitrary angular orientation, said anchor portion cylindrical mating element being an open ended cylindrical bore, and said starting platform portion cylindrical mating element being a cylindrical support post sized for mating engagement within the cylindrical bore of the anchor portion; and said portions having respective mating key elements for fixing the mating engagement of said portions at a desired angular orientation when fully engaged, the anchor portion mating key element comprising an open-ended slot in the open end of the anchor bores, and the starting platform portion mating key element comprising a pin fixedly attached to and projecting from the starting platform cylindrical support post.

2. The invention of claim 1 wherein an interior diameter of the cylindrical bore is within a tolerance of approximately three thousands of an inch relative to an exterior diameter of the starting platform cylindrical support post.

3. The invention of claim 1 wherein the starting platform portion further comprises a diving platform affixed to the cylindrical support post.

4. The invention of claim 3 wherein the starting platform portion further comprises a step affixed to the cylindrical support post.

5. The invention of claim 4 wherein the starting platform portion further comprises a backstroke bar affixed to the cylindrical support post.

6. The invention of claim 1 wherein the starting platform portion further comprises a backstroke bar affixed to the cylindrical support post.

7. The invention of claim 1 wherein the anchor portion and the cylindrical support post are made of stainless steel.

8. A swimmer's starting platform assembly comprising:

an anchor portion for fixed mounting relative to a swimming area and a removable starting platform portion for use during swimming events;

said portions having respective cylindrical mating elements for initial engagement at any arbitrary angular orientation, said anchor portion cylindrical mating element being an open ended cylindrical bore, and said starting platform portion cylindrical mating element being a cylindrical support post sized for mating engagement within the cylindrical bore of the anchor portion; and said portions having respective mating key elements for fixing the mating engagement of said portions at a desired angular orientation when fully engaged, one of the anchor portion and the starting platform portion comprising a first mating key element comprising a pair of open-ended opposed slots in the open end of the one of the anchor portion and the starting platform portion, and the other one of the anchor portion and the starting platform portion comprising a second mating key element comprising a pair of opposing pins fixedly attached to and projecting from the other one of the anchor portion and starting platform portion.

9. A swimmer's starting platform assembly comprising:

an anchor portion for fixed mounting relative to a swimming area and a removable starting platform portion for use during swimming events;

said portions having respective cylindrical mating elements for initial engagement at any arbitrary angular orientation, said anchor portion cylindrical mating element being an open ended cylindrical bore, and said starting platform portion cylindrical mating element being a cylindrical support post sized for mating engagement within the cylindrical bore of the anchor portion; and said portions having respective mating key elements for fixing the mating engagement of said portions at a desired angular orientation when fully engaged, the starting platform portion mating key element being a rod that extends through the cylindrical support post affixed to the cylindrical support post to form opposing pins that project from an outer surface of the cylindrical support post, and the anchor portion mating key element comprising two open-ended opposing slots in the open end of the anchor bore.

10. A method for deploying a swimmer's starting platform assembly having an anchor portion and a removable starting platform portion for use during swimming events comprising:

providing the anchor portion and the starting platform portion with respective cylindrical mating elements for initial engagement at any arbitrary angular orientation and respective mating key elements for fixing the mating engagement of said portions at a desired angular orientation when fully engaged, the cylindrical mating element provided for the anchor portion being an open ended cylindrical bore and the cylindrical mating element provided for the starting platform portion being a cylindrical support post sized for mating engagement within the cylindrical bore of the anchor portion, the mating key element provided for the anchor portion being an open-ended slot defined in the open ended cylindrical bore and the mating key element provided for the starting platform portion being a pin affixed to the cylindrical support post and projecting at a selected location from the cylindrical support post sized for mating engagement within the open-ended slot of the anchor portion;

securing the anchor portion at a selected location proximate a swimming area such that the anchor has a selected orientation relative to the swimming area;

initially engaging the cylindrical mating elements of the anchor portion and starting platform portion, the initial engagement of the respective portions comprising inserting the support post into the anchor portion bore; and engaging the mating key elements of the anchor portion and starting platform portion to a fully engaged position, the engaging of the respective portions comprising inserting the support post into the anchor portion bore such that the affixed support post pin becomes engaged in the open-ended anchor bore slot, whereby the starting platform portion is securely positioned for use with a desired orientation relative to the swimming area based on the selected orientation of the anchor.

11. The method of claim 10 further comprising:

providing an anchor bore cover selectively configured for engagement with the anchor bore open end;

removing the support post portion from engagement with the anchor portion; and engaging the anchor bore cover with the anchor bore open end.

12. The method of claim 10 further comprising:

providing an anchor bore cover selectively configured for engagement with the anchor bore open end;

removing the support post portion from engagement with the anchor portion; and engaging the anchor bore cover with the anchor bore open end.

13. The method of claim 10 wherein the securing the anchor portion at a selected location proximate a swimming area includes embedding the anchor portion in a pool deck such that the anchor bore opens upon a surface of the deck.

14. The method of claim 10 wherein the securing the anchor portion at a selected location proximate a swimming area includes embedding the anchor portion in wet cement of a pool deck such that it does not protrude above the deck.

* * * * *

UNITED STATES PATENT AND TRADEMARK OFFICE

CERTIFICATE OF CORRECTION

PATENT NO. : 7,058,994 B2
APPLICATION NO. : 10/685888
DATED : June 13, 2006
INVENTOR(S) : Weimer et al.

It is certified that error appears in the above-identified patent and that said Letters Patent is hereby corrected as shown below:

IN THE SPECIFICATION

Column 4, Line 24, after the word “relative” delete “the”.

Column 4, Line 40, before the word “FIG.” delete “to”.

Column 5, Line 38, before the word “pulling” delete “the”.

Column 6, Line 29, after the word “anchor”, delete “bores” and insert therefore -- bore --.

Column 7, Line 1, before the word “one” delete “the”.

Signed and Sealed this

Fifteenth Day of May, 2007

JON W. DUDAS
*Director of the United States Patent and Trademark Office*